US006569817B1

(12) United States Patent
Maeder et al.

(10) Patent No.: US 6,569,817 B1
(45) Date of Patent: May 27, 2003

(54) COMPOSITION FOR TREATING SURFACES OF FLAT OBJECTS TO PRODUCE PREDETERMINED SEPARATION POINTS TO PLURALITY OF SUCH FLAT OBJECTS ARRANGED AT LEAST PARTIALLY IN A PILE

(75) Inventors: Carl Conrad Maeder, Hinwil (CH); Markus Scheuber, Weisslingen (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/402,989

(22) PCT Filed: Apr. 7, 1998

(86) PCT No.: PCT/CH98/00128

§ 371 (c)(1),
(2), (4) Date: Oct. 13, 1999

(87) PCT Pub. No.: WO98/46507

PCT Pub. Date: Oct. 22, 1998

(30) Foreign Application Priority Data

Apr. 16, 1997 (CH) ..... 0888/97

(51) Int. Cl.[7] ..... C10M 125/02; C10M 159/06; B65H 3/18

(52) U.S. Cl. ..... 508/120; 508/126; 508/130; 508/148; 508/208; 508/451; 428/323

(58) Field of Search ..... 508/120, 130, 508/126, 148, 451

(56) References Cited

U.S. PATENT DOCUMENTS 3,756,627 A * 9/1973 Reist ..... 283/38
4,252,658 A * 2/1981 Tasaka et al. ..... 252/29
4,525,287 A * 6/1985 Carstensen ..... 252/26
4,869,948 A 9/1989 Iida et al. ..... 428/216
5,076,339 A * 12/1991 Smith ..... 164/72
5,468,401 A * 11/1995 Lum et al. ..... 252/22
5,766,775 A * 6/1998 Kijima et al. ..... 428/537.5
5,776,866 A * 7/1998 Karaki et al. ..... 508/122
6,123,990 A * 9/2000 Wiggins et al. ..... 427/242

OTHER PUBLICATIONS

Patent Abstracts of Japan, Publication No. 63197079, Publication Date Aug. 15, 1988.

* cited by examiner

*Primary Examiner*—Ellen M. McAvoy
(74) *Attorney, Agent, or Firm*—Rankin, Hill, Porter & Clark LLP

(57) ABSTRACT

A composition containing an anti-static agent and a lubricant for treatment of a surface of a flat article (2) so as to define point of separation of a plurality of at least partly superimposed flat articles. Due to the lubricant, the friction coefficient between the treated surface and a surface of an adjacent article and, therefore, the static friction between the two articles is reduced. Due to the anti-static agent, static charging of the treated article and, therefore, adhesion between articles obtainable through static charging is reduced. In a plurality of superimposed, flat articles statically charged in a d.c. voltage field, the named two effects produce a displacement at the location of a treated surface, when a displacement force (11) with a component parallel to the principal surfaces of the articles is applied to the plurality of articles.

11 Claims, 1 Drawing Sheet

COMPOSITION FOR TREATING SURFACES OF FLAT OBJECTS TO PRODUCE PREDETERMINED SEPARATION POINTS TO PLURALITY OF SUCH FLAT OBJECTS ARRANGED AT LEAST PARTIALLY IN A PILE

BACKGROUND OF THE INVENTION

The present invention relates to a composition used for the treatment of surfaces of flat articles. A surface of a flat article treated with the composition forms a predetermined separation point in a plurality of at least partly superimposed flat articles, i.e. a predetermined point where the plurality of superimposed flat articles can be selectively separated. The flat articles are, for example, made from paper, cardboard, fabric, felt or plastic. The plurality of flat articles to be separated may be a multi-page printed product of paper, plastic or cardboard, which is to be opened at a given point, or may be a stack or scale formation of printed products or flat articles of cardboard, fabric, felt or plastic from which a specific number of articles to be removed by separation at a predetermined point.

Superimposed, flat articles are frequently separated from one another by shoving a separating element such as a separating wedge between the articles to be separated. The more congruent, thin and sensitive to mechanical damage the articles in question are, the more difficult it is to successfully effect a separation using a separating element. On the one hand, it is difficult to aim the element precisely at a predetermined point and, on the other hand, the risk of the separating element damaging the narrow sides or edges of the flat articles is not negligible.

Therefore, superimposed, flat articles are advantageously displaced against one another parallel to their principal surfaces, prior to an effective separation. By such displacement, areas of the principal surfaces of individual articles are exposed, which areas are much better suited for being acted on by a mechanical separating element than the narrow side areas of the articles.

CH-440339 describes a method for displacing relative to each other two directly superimposed articles within a plurality of superimposed articles wherein a displacement force having a component parallel to the principal surfaces of the articles is employed. In this method, there is no action on individual narrow sides or edges of the articles. To enable the mentioned displacement to take place between two specific articles of the plurality of superimposed articles (predetermined separation point), while the other articles remain substantially undisplaced with respect to one another, the adhesion between the two specific articles is reduced compared with the adhesion between the other articles by measures suitable for reducing the friction coefficient between the two specific articles.

Measures for reducing the friction coefficient include treating at least one of the surfaces to be displaced relative to each other with a lubricant or smoothing it or positioning a sliding film between the articles to be displaced. Examples of lubricants are waxes, high-viscosity silicone oils or dry lubricants.

Building upon the teaching of the aforementioned patent, CH-534588 describes how a stack of flexible sheets is made separable at a plurality of different, predetermined points, by applying friction coefficient reducing measures to different, predetermined sheets in non-overlapping areas. The stack is separated at a specific one of the predetermined separation points by directing the displacement force to the corresponding treated area.

It has been found that the processes and the lubricants used in the methods according to CH-440339 and CH-534588 give satisfactory results in many applications. However, it has been found also that in other cases the reliability with which the displacement is effected exactly in the predetermined point is not adequate, so that the method cannot be used when high demands are made. Such cases include the separation of pages of multi-page printed products for the purpose of opening the product at a predetermined point. This is especially so when the individual pages of the printed products are made from a very smooth or correspondingly coated material and therefore adhere very little to one another, and/or when the individual pages of the printed products are made from different materials with different friction characteristics.

SUMMARY OF THE INVENTION

In a patent application of the same applicant and filed in parallel with the present application, a method for the separation of a plurality of at least partly superimposed, flat articles at a predetermined point is described. Using this method it becomes possible to solve separating problems in application areas in which the known methods cannot be applied, and/or to attain better results than are possible with the known methods.

An object of the present invention is to provide a composition for the treatment of surfaces of flat articles. The composition is to be used in the aforementioned method according to the parallel application, in order to produce the predetermined separation point.

The method described in the parallel application is based on the fact that the adhesion between superimposed, flat articles can be increased by static charging of their surfaces. According to the method of the parallel application, a static charge is produced on the surfaces of the superimposed, flat articles, by passing the articles through an electric d.c. voltage field oriented substantially perpendicular to the principal surfaces of the articles. Due to the effect of the field, dipoles are oriented or charges are displaced perpendicular to the principal surfaces and positive or negative charges are concentrated on the two surfaces of each of the articles. These charges cause electric attraction forces between the surfaces of superimposed articles and, therefore, increase the mutual adhesion.

The effect of the static charging of surfaces of superimposed, flat articles is reduced or prevented for at least one of two surfaces participating at a predetermined separation point, by treating the surface beforehand with an anti-static agent. Due to the limited conductivity of the anti-static agent, charges cannot concentrate on the treated surface or they are very rapidly compensated. Thus, passage through the voltage field causes no adhesion increase at the separation point or at least much less adhesion increase than it causes between non-treated surfaces. Therefore, the treated surfaces can be moved relative to each other by a lower force than is necessary for displacing non-treated surfaces, which displacement by low force distinguishes the separation point.

Application of a static charge for increasing the adhesion between flat articles not to be separated combined with a planned application of anti-static agent for suppressing the effect at a separation point can also be combined with the reduction of the friction between the flat articles to be separated by applying a lubricant, as described hereinbefore as prior art. Since for such a combination the anti-static agent and the lubricant are advantageously used on the same surface areas, the two agents can be applied and used simultaneously in the form of a mixture in a single method step. It is also possible to add a luminophore to the anti-static agent or to the mixture of anti-static agent and lubricant, the luminophore being useful for checking the separation at the predetermined separation point with the aid of luminescence sensors.

The composition according to the invention is a mixture comprising an anti-static agent and a lubricant. The mixture may comprise additional components such as a luminophore.

BRIEF DESCRIPTION OF THE DRAWINGS

These and further features of the present invention will be apparent with reference to the following description and drawings wherein FIG. 1 diagrammatically illustrates successive method steps using an example of a stack comprising five superimposed, flat articles.

DETAILED DESCRIPTION OF THE PREFERRED EMBODIMENT

Figure 1:
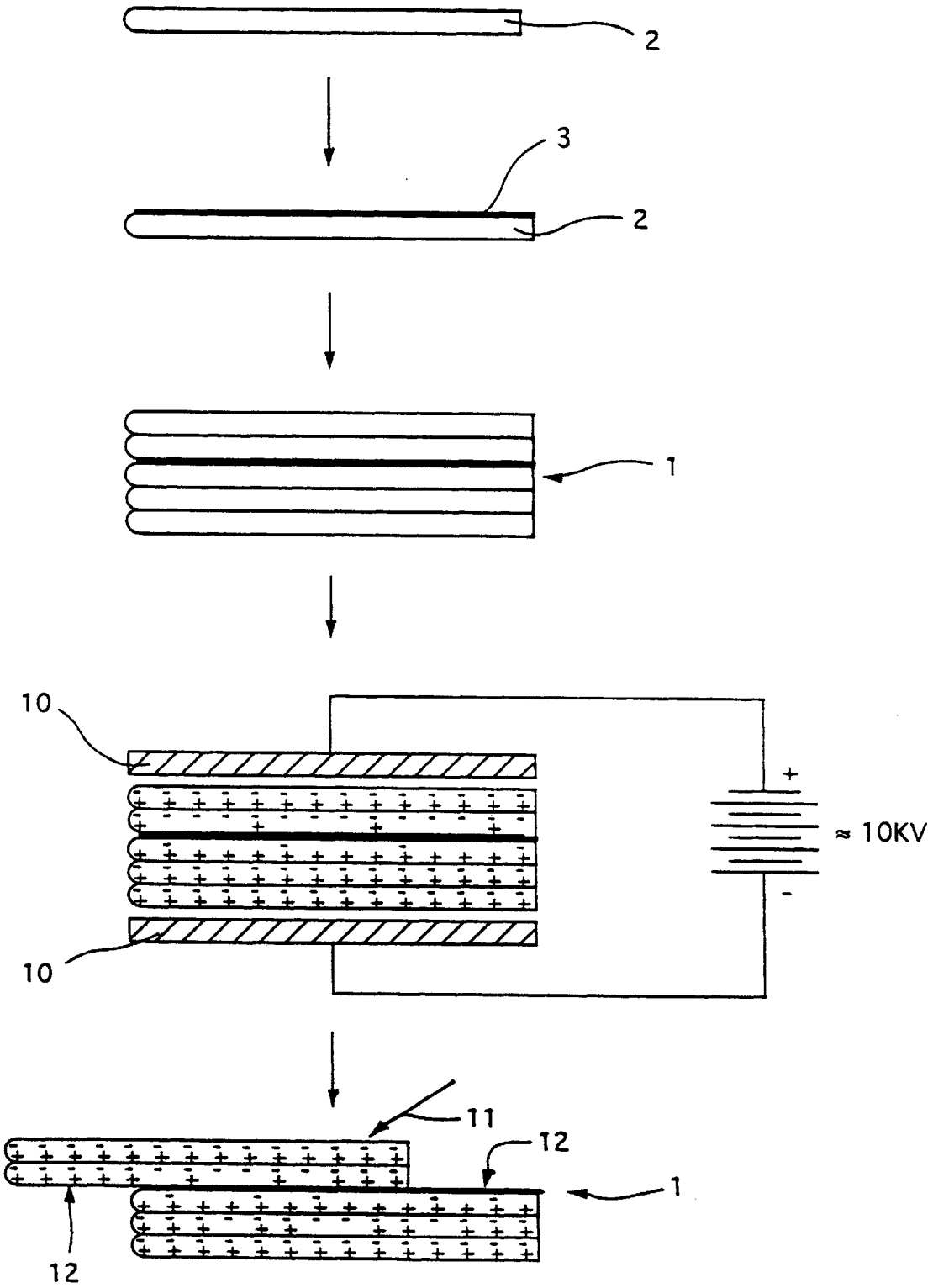

The method in which the composition according to the invention is to be used is described in greater detail in connection with FIG. 1, which illustrates successive method steps using the example of a stack 1 comprising five superimposed, flat articles 2. The stack is to be separated by displacing the two upper articles with respect to the three lower articles. Thus, the predetermined separation point is located between the upper surface of the third article and the lower surface of the fourth article within stack 1.

Before or during stacking articles 2, at least one of the surfaces participating at the separation point is treated, e.g. coated with an anti-static agent 3 or preferably with the inventive composition containing an anti-static agent and a lubricant.

The surface treated with the inventive composition 3 constitutes within the stack one of the surfaces to be displaced relative to each other. It is obviously also possible and even advantageous in certain applications, to treat not only one surface of the separation point, but instead treat both surfaces participating at the separation point with the composition.

The stack 1 is then exposed to a d.c. voltage field, wherein the field lines are oriented substantially perpendicular to the principal surfaces of the articles. For this purpose the stack is passed between two electrodes 10, e.g. between two plates or rods to each of which a different constant potential is applied. By the effect of the field, dipoles are oriented or charges are displaced within the flat articles. Between the two surfaces of an article a potential difference is built up or the surfaces of the article are statically charged (diagrammatically represented by small plus and minus signs in FIG. 1). These charges are opposed at superimposed surfaces of adjacent articles and cause electric forces of attraction between the articles.

At surface points where the composition according to the invention acts, little or no charge can build up as a result of the increased surface conductivity, so that in such surface areas the forces of attraction between the articles are correspondingly lower.

Immediately after static charging, a displacement force (arrow 11), e.g. acting on the stack surface and having a component parallel to the principal surfaces of the articles is applied to the stack 1. By this displacement force 11 the two surfaces in the stack adhering least to one another and showing the least friction between each other are displaced relative to one another, even if the force does not act at the separation point but acts, for example, on the stack surface.

By displacing two articles of the stack against one another, areas 12 of principal surfaces of these articles are exposed and can be acted on with mechanical means in order to effectively separate the articles of the stack. For such an action the risk of damaging the articles is much lower than for an action on narrow sides (edges) of articles as is necessary for a separation without prior displacement. In addition, the exposed principal surfaces define the separation point in such a way that it cannot be missed by a mechanical separating element.

The anti-static agent contained in the composition according to the invention is, for example, an anti-static agent known from the plastics industry. The anti-static agent comprises conductive particles (e.g. carbon black, carbon fibers, nickel-coated mica, steel fibers or aluminum platelets or the conductive pigment Minatec® sold by Merck in Darmstadt) distributed in ultra-fine manner in a matrix, or ionic compounds (e.g. quaternary ammonium salts), surfactants (e.g. glycol esters, glycol ethers or esters and salts of fatty acids) or hygroscopic substances (e.g. glycerol or polyglycol), which are used as such or in the form of aqueous or alcoholic solutions.

The lubricant contained in the composition according to the invention is a lubricant usable in the aforementioned methods according to CH-440339 and CH-534588. It is, for example, a wax, which can be a natural wax (e.g. beeswax), a chemically modified, originally natural wax (e.g. hydrogenated jojoba wax, paraffin wax produced from petroleum) or a synthetic wax (e.g. polyethylene glycol wax), a high-viscosity silicone oil or a suitable plastic (e.g. Teflon).

For the preparation of the composition according to the invention the components are merely mixed together and part of the components can optionally be brought into a liquid or at least a plastic state. The finished composition is liquid or pasty or solid in lump form or in the form of granules or powder.

The treatment of the surfaces involves spraying or application with a roller for liquid or pulverulent compositions or for compositions in the melted state. Subsequent treatment of the treated surfaces with heat, for example, may be necessary in order to fix the composition to the surface. Solid compositions are advantageously applied by direct rubbing onto the surface to be treated or by rubbing off with the aid of a brush.

Preferred embodiments of the composition according to the invention comprise a wax or a plastic (lubricating component), in which the conductive particles (conductive component) are incorporated. Such compositions can be very easily rubbed onto paper surfaces.

A specific embodiment of the inventive composition consists of paraffin wax and the aforementioned pigment Minatec®. This composition is particularly suitable for the treatment of printed products, because it is invisible when applied to paper and scarcely otherwise detectable by the reader. The weight fraction of the wax is preferably in the range between 55 and 75%, more preferably between 66 and 67%.

To enable the composition according to the invention to be applied by spraying, the composition can additionally contain a solvent or water.

Further embodiments of the composition according to the invention are obtained by mixing any of the aforementioned anti-static agents with any suitable lubricant. For specific applications, advantageous compositions (both as regards components and as regards concentrations of the individual components) are to be established experimentally.

What is claimed is:

1. Composition for the treatment of surfaces of flat articles (2) for producing predetermined separation points in a plurality of said articles being at least partially superimposed, wherein the composition comprises a mixture of an anti-static agent for reducing static charging of a treated surface in a d.c. voltage field and a lubricant for reducing a friction coefficient between the treated surface and another surface.

2. Composition according to claim 1, further comprising a solvent or water.

3. Composition according to claim 1, further comprising a luminophore.

4. Composition according to claim 1, wherein the anti-static agent consists at least partly of electrically conductive particles, of an ionic compound, of a surfactant or of a hygroscopic substance.

5. Composition according to claim 1, wherein the lubricant comprises a wax, a high-viscosity silicone oil or a plastic.

6. Composition according to claim 1, wherein the composition is liquid or pulverulent and can be applied by spraying or roller application to the treated surface.

7. Composition according to claim 1, wherein the composition is in granular form and is brought into a liquid or plastic state for application.

8. Composition for the treatment of surfaces of flat articles (2) for producing predetermined separation points in a plurality of said articles being at least partially superimposed, wherein the composition comprises an anti-static agent for reducing static charging of a treated surface in a d.c. voltage field and a lubricant for reducing a friction coefficient between the treated surface and another surface, and wherein the anti-static agent is a conductive pigment and the lubricant is paraffin wax.

9. Composition according to claim 8, wherein the paraffin wax represents 55 to 75% of the weight of the composition.

10. Composition according to claim 8, wherein the paraffin wax represents 66 to 67% of the weight of the composition.

11. Composition according to claim 1, wherein the composition is solid and is applied by rubbing onto the treated surface.

* * * * *

UNITED STATES PATENT AND TRADEMARK OFFICE

CERTIFICATE OF CORRECTION

PATENT NO. : 6,569,817 B1
DATED : May 27, 2003
INVENTOR(S) : Maeder et al.

It is certified that error appears in the above-identified patent and that said Letters Patent is hereby corrected as shown below:

Title page, Item [54] and Column 1, line 4,
Delete "TO" and insert -- IN A --.

Signed and Sealed this

Twenty-third Day of September, 2003

JAMES E. ROGAN
*Director of the United States Patent and Trademark Office*